United States Patent [19]

Striebig

[11] 4,183,272

[45] Jan. 15, 1980

[54] MECHANISM FOR CUTTING PANELS TO SIZE

[76] Inventor: Ludwig Striebig, Grossmatte, CH-6014 Littau, Switzerland

[21] Appl. No.: 895,518

[22] Filed: Apr. 11, 1978

[51] Int. Cl.[2] ..... B27B 5/06

[52] U.S. Cl. ..... 83/411 R; 83/417; 83/471.3

[58] Field of Search ..... 83/417, 281, 471.1, 83/471.2, 471.3, 487, 648, 928, 410, 411 R; 225/96.5

[56] References Cited

U.S. PATENT DOCUMENTS

| | | | |
|---|---|---|---|
| 3,194,464 | 7/1965 | Aksnes | 225/96.5 |
| 3,414,027 | 12/1968 | Larva, Sr. et al. | 83/928 X |
| 3,668,955 | 6/1972 | Rupprecht | 225/96.5 X |
| 3,830,121 | 8/1974 | Makeer et al. | 83/417 X |
| 3,933,067 | 1/1976 | Clark | 83/928 X |
| 3,945,285 | 3/1976 | Gebhardt | 83/471.3 X |

FOREIGN PATENT DOCUMENTS

| | | | |
|---|---|---|---|
| 1300656 | 6/1962 | France | 225/96.5 |

*Primary Examiner*—J. M. Meister

*Attorney, Agent, or Firm*—Toren, McGeady and Stanger

[57] ABSTRACT

In a mechanism for cutting panels, including an approximately vertically standing backing structure for the panels to be cut and a lower panel edge support to define a work area through which a saw mounted on a carrier may be moved, the panels may be secured in their working position and moved into and out of the work area by means of a cantilever arm mounted on the backing structure outside the work area for pivotal movement, whereby a gripping device on the free end of the arm is moved into and out of the work area.

12 Claims, 7 Drawing Figures

FIG.1
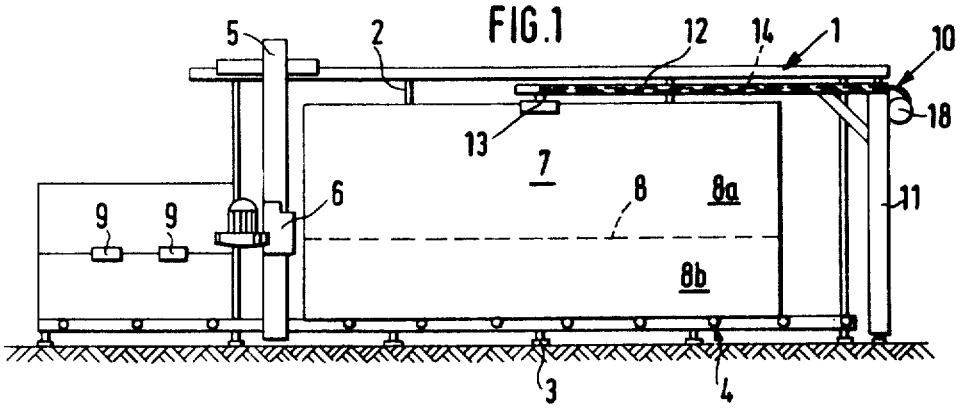
FIG.2
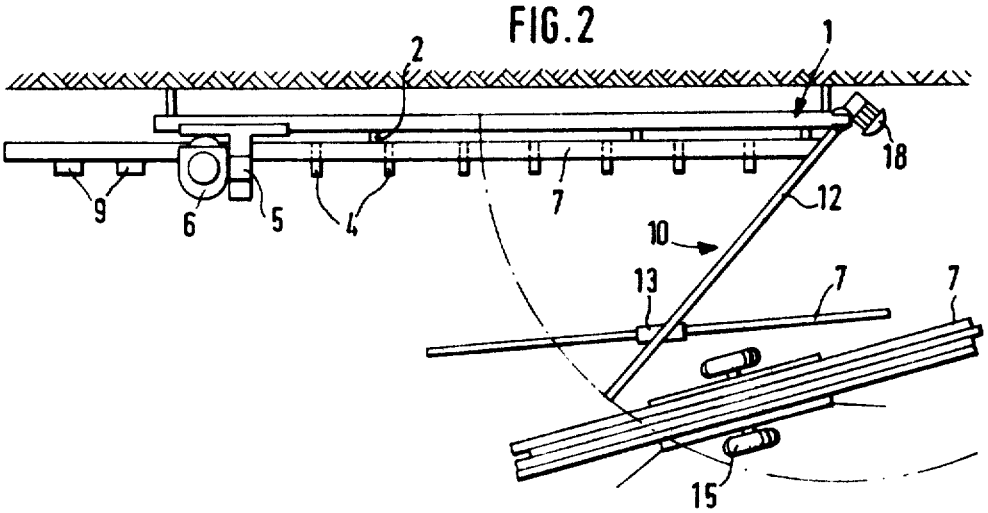
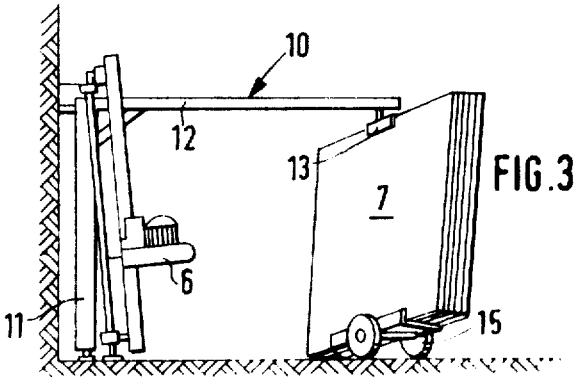
FIG.3

MECHANISM FOR CUTTING PANELS TO SIZE

The invention relates to a mechanism for cutting panels, such as chipboard, plywood, plastic panels and the like to size comprising an approximately vertically standing frame structure including a backing grid as a two-dimensional backing for a horizontal and vertical cutting to size of the panels which are to be deposited on a horizontal panel edge support, a saw carrier bar shiftably guided on the frame structure with a saw unit capable of being displaced relative to the bar, and a device for gripping and fastening an edge portion of panels to be cut or of panel sections not yet cut.

In known apparatus (German Pat. No. 2,305,673), the cutting process is carried out in such a manner that a longitudinal edge portion of a panel is deposited on the horizontal panel edge support in an approximately vertical plane, thereafter a longitudinal strip is severed at first from the lower part of the panel which is bounded by the lower edge support, whereas the remainder of the panel, located above the cut slit, is held fast at a distance from the edge support defined at least by the slit until the lower, severed, longitudinal strip has been worked up further into the workpieces which are to be prepared therefrom and has been removed from the edge support. Thereafter, the held, upper part of the panel may be lowered to the panel edge support, and a new horizontal, longitudinal cut may be started.

The known mechanism for gripping the panel edge and holding the same fast which is employed for carrying out this mode of operation is a clamping device movably guided on the frame structure which engages the two opposite, vertically extending, lateral edges of a panel and can hold the panel firmly clamped practically on two sides. The clamping elements of the clamping device are arranged for adjustment in the direction of height so that they may always be adjusted to a position above a slit to be cut so that the panel part to be severed is fully accessible over its entire length. As long as the known clamping elements engage the two lateral edges of the panel, the panel material can be sawed apart only in a horizontal direction and in those sections of its area which are located below the clamping elements. If one were to perform a horizontal cut above the clamping area of the known fastening means, the weight of the panel portion located above the cut slit would increasingly narrow the sawed slit so that only an ill-defined cut could be achieved if the sawing process can be carried to its end at all. If one wished to carry out a vertical cut in the panel material clamped at two sides, similar interference with the cutting would have to be expected because components of force originating from the clamping elements and acting in opposite directions occur during clamping fast of vertical edge sides. Particularly, it is not possible with the known apparatus further to process smaller panel portions nor to sever small vertical strips because it is impossible to provide a backing grid with closely spaced elements.

As is well known, it is necessary for the smallest possible scrap losses and thus for an economical utilization of the material during sawing up of panels of large area that the individual cuts be precisely defined before the sawing process starts. It is found frequently that it would be most advantageous first to sever a few vertical strips from a large panel, and thereafter to subdivide the remainder of the panel by means of further horizontal and vertical cuts. If such a cutting scheme were used as a basis for operating the known mechanism, it would be necessary to remove the clamping elements engaging the panel from its lateral edges when carrying out vertical cuts, and again to fasten the elements thereafter, a procedure obviously costly in labor.

It is also known that the panels to be processed are more or less moist in their marginal areas than in their central zones. This differential distribution of moisture within a panel produces internal stresses which are set free on sawing. This leads to a warping of the panel portions, the opposite bounding surfaces at the cut slit being particularly apt to arcuate deformation. Because a saw blade generally has a thickness of only about 3 mm, the upper remainder of a panel must be lifted slightly before the lower remainder of the panel is moved laterally to permit displacement without interference. Such separate lifting of the upper panel also cannot be carried out readily by means of the known mechanism.

The object of the invention resides in providing a device for gripping and fastening an edge of panel material in a mechanism for cutting panels to size which permits universal cutting to size of the desired work pieces from the panel material. At that, the device should be simple in its structure, reliable in its operation, and readily inspected and safe in its manipulation, and capable of being installed as a supplemental structural element in a vertical panel saw already in use without requiring major changes to be carried out.

This object is achieved in a mechanism of the type initially defined by the fact that the mechanism includes an arm cantilevered from a lateral section of the frame structure into the working area defined by this structure and the backing grid, the section of the arm directed toward the working area being provided with a gripping and fastening device for engaging panels or panel portions in a section of its edge opposite the horizontal panel edge support.

It is possible to grip the panel material to be processed, that is, an individual panel, several panels superimposed in area contact, or panel sections by means of the mechanism according to the invention at a section of the edge which is the upper edge of the panel material relative to the horizontal panel edge support because of the mode of engagement of the gripping and fastening device of the invention in such a manner that it is held suspended practically as from a crane so that the entire area of the panel, except for the relatively small area of engagement by the gripping and fastening device may be sawed through unimpeded in a horizontal and vertical direction.

It is advantageous that the cantilever arm be mounted on a lateral section of the frame structure near the upper edge of the work area relative to the horizontal panel edge support for pivotal movement about a vertical axis. In this manner, the working area remains available without hindrance over its full extent, and the gripping and fastening device may be swung out of the working area with the cantilevered arm for engaging a section of the upper edge of the panels to be processed in an area outside the sawing mechanism, for example, from a panel transporting carriage standing by, and transport the same to the working surface when the arm swings back, so that they may then be deposited on the horizontal panel edge support.

It is advantageous to provide a lifting device by means of which the gripping and fastening device may be raised and lowered relative to the work surface so that the entire arrangement practically combines two functions in a unitary work process, namely the function of a pivoting crane which transports the panels to the working surface of the mechanism, and the function of a holding device which holds the panel fast to this working surface in such a manner that the desired cut may be performed in a universal mode of operation. A particularly stable arrangement which is capable of heavy loading is provided, according to a preferred embodiment of the invention, with a pivoting column providing a vertical pivot bearing for the cantilevered arm and standing adjacent one lateral edge of frame structure mainly behind the working surface as viewed from the operating side, the cantilevered arm being fastened to the column and laterally projecting from the same. The pivoting column may be supported in such a manner that only its upper end carrying the cantilevered arm projects a little into the working surface, whereby the cantilevered arm may be guided very closely over the working surface, yet an extension of the working surface beyond the lateral edges of the frame structure, which may be needed, is not interfered with. Making the vertical pivot bearing of the cantilevered arm a pivoting column permits the structure of the entire mechanism to be made more compact, whereby it is particularly well suited for later installation in panel saws already in use.

The gripping and fastening device for engagement with a section of the upper edge of panels or panel portions may be provided with several grippers movable relative to each other and along the cantilevered arm and capable of being actuated jointly be means of the lifting device. This design of the gripping and fastening device permits simple, multiple-point fastening of the panels within the afore-mentioned section at the upper panel edge.

According to one embodiment of the invention, the cantilevered arm is arranged to project to the longitudinal center of the working surface, and the gripping and fastening device includes a gripper rotatable about a vertical axis below the top of the arm and capable, because of its rotatability relative to the arm, of engaging panels deposited or made ready within range of the swinging arm movement approximately in the center of their upper edge at any angular position so that it is not necessary always to align a stock of panels parallel to the angular position of the cantilevered arm. In this embodiment, the lifting device further includes a lifting drive connected with the gripper by a hoisting cable guide on the cantilevered arm. For reasons of stability, the lifting drive may be fastened to the pivoting column.

In a further embodiment of the invention, the cantilevered arm also extends approximately to the longitudinal center of the working surface, but the gripping and fastening device consists of a cross bar extending approximately over the length of the working surface and pivotally mounted on the free end of the cantilevered arm for movement about a vertical axis and parallel to the horizontal panel edge support. Additionally, at least two grippers movable longitudinally and relative to each other are provided on this cross bar which are adjustable practically for panel edges of different lengths and permit a two-point suspension. Because the lifting drive of the lifting device in this embodiment is fastened at a terminal area of the cross bar and connected with a hoisting cable guided on the cross bar for jointly and uniformly operating the grippers, a panel engaged by the gripping and fastening device of this embodiment may be raised by means of the lifting device for parallel movement, and, because of the horizontal pivoting mounting of the cross bar, it may be lowered to the horizontal panel edge support with its lower panel edge parallel to the support.

According to a third embodiment of the invention, the gripping and fastening device is constituted by a trolley provided on the cantilevered arm below its terminal section extending into the working area, the trolley being suspended by means of two connecting sections for movement parallel to the cantilevered arm in the direction of elongation of the same. Furthermore, a gripper rail is provided on the trolley and is rotatable about a vertical axis, and its approximate longitudinal center is preferably fastened on the underside of the trolley in the central area of the latter. When this gripper rail engages a section of the upper panel edge, it acts with a stability analogous to that of a two-point suspension because of its considerable length and thereby permits the upper panel edge to be aligned necessarily parallel to the cantilevered arm when the gripper rail is swung into the plane of the trolley, and thereby an alignment of the lower panel edge with the horizontal panel edge support.

The grippers or the gripper rail employed in the afore-described gripping and fastening devices may preferably have a U-shaped gripping section open toward the horizontal panel edge support whose inner transverse clearance is greater than the greatest thickness of the panel edge to be gripped, and suitable clamping elements may be provided in the interior of this gripper section for fastening the panel edges. These clamping elements are preferably provided with clamping members designed in such a manner that they permit the panel edge to be engaged to enter the interior area of the gripper profile when the open side of the gripper profile is sat on it, but prevent subsequent withdrawal by clamping the engaged panel edge section.

Further features of the invention are defined in the claims dependent from the principal claim.

A few embodiments of the invention are being described in greater detail with reference to the drawings, wherein:

FIG. 1 diagrammatically shows a mechanism for cutting panels to size according to the features of the invention in front elevation;

FIG. 2 is a top plan view of the mechanism according to FIG. 1 for illustrating a panel transport to the working surface of the mechanism;

FIG. 3 is a side elevation of the mechanism shown in FIG. 1 for further making clear the panel transport shown in FIG. 2;

Figure 4:
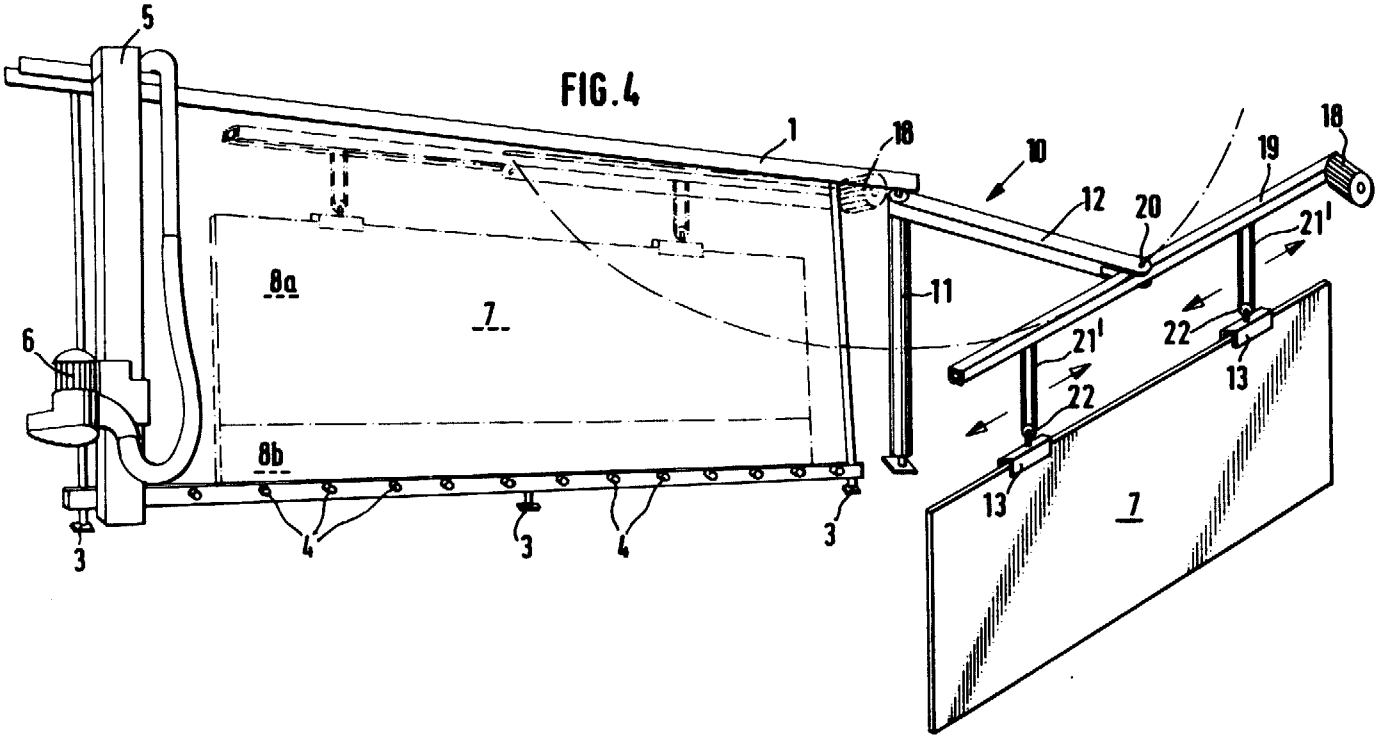
FIG. 4 is a schematic, perspective representation of a modified embodiment of the mechanism for cutting panels to size.

The mechanisms for cutting panels to size which are shown in FIGS. 1 to 6 have a fundamentally identical basic structure, and thus include a frame structure 1, a backing grid 2 connected therewith which provides a two-dimensional backing for horizontal and vertical cutting of the panel material to size, and a row of feet 3 on which the frame structure 1 rests. A horizontal panel edge support 4 is constituted by a row of lower supporting rollers on which the lower edge of a panel 7 may be shifted easily along the backing grid 2, if necessary, after unlocking of the rollers. A saw carrier bar 5 is guided on the frame structure 1 for longitudinal shifting movement, and a sawing unit 6 is supported thereon also for adjusting movement. This sawing unit may be moved vertically along the saw carrier bar 5 for performing vertical cuts, and its saw blade stands parallel to the saw carrier bar for performing horizontal cuts and can be swung transverse to the saw carrier bar 5 (FIG. 1) and can be shifted jointly with the latter longitudinally over the working surface of the mechanism. Details of the afore-described general structure of a mechanism for cutting panels to size are evident, for example, from the Austrian Pat. No. 231,690.

If the panel 7, for example, a chipboard panel, is to be divided horizontally along a line of cut 8 indicated in broken line into an upper panel portion 8*a* and a lower panel portion 8*b*, it is necessary to hold the upper panel portion fast at least during the severing in such a manner that it cannot sink under its own weight whereby it would narrow the line of cut. A device 10 for gripping and fastening an edge of the upper panel portion 8*a* consists of an arm 12 cantilevered from the right lateral section of the frame structure 1, as viewed in FIG. 1, horizontally into the working surface and a gripper 13 on the free end of the arm engaging a relatively short section of the upper panel edge of the panel portion 8*a* and holding the same fast in its illustrated position during the cutting process. After the cut along the line 8 has been completed, and while the upper panel portion 8*a* remains fastened, the lower panel portion 8*b* may be shifted laterally, for example toward the left against adjustable abutments 9, and subdivided into suitable workpieces by vertical cuts. The remaining upper panel portion 8*a* may thereafter be lowered by means of the device 10 to the horizontal panel edge support 4, and a new horizontal cut may be started.

The cantilevered arm 12 of the device 10 is supported for swinging movement in a horizontal plane and is provided for this purpose with a pivoting column 11 standing next to the working surface on the frame structure 1 on the right, as viewed in FIG. 1, the arm being fastened to the upper column end in laterally projecting relationship and being secured against angular movement and braced. The pivoting column 11 stands vertically even when seen from the side according to FIG. 3, and is located essentially behind the working surface of the mechanism provided on the backing grid 2, only the upper column end projecting into the plane of the working surface so that the cantilever arm cannot be swung to the working surface.

The gripping and fastening device provided for engaging the chipboard panel 7 and for holding it fast consists, according to FIG. 1, of a single gripper 13 which is provided below the tip of the cantilevered arm and rotatable about a vertical axis, the arm 12 extending approximately to the longitudinal center of the working surface. A lifting drive 18 is fastened to the upper end of the pivoting column 11 and is connected with the gripper 13 by a hoisting cable 14 which is guided in the cantilevered arm.

The manner in which panels deposited at any desired angle within the sector of swinging arm movement may be engaged and transported to the working surface at the backing grid is evident from FIGS. 2 and 3. Several panels 7 are deposited in ready, approximately vertical position on a panel transporting carriage 15, and the cantilevered arm 12 is being pivoted with its gripper 13 about the pivoting column 11 in a direction toward the panel transporting carriage 15. Because of the vertical rotatability of the gripper 13, it may be set on the upper panel edge of a panel 7 on the transporting carriage 15, and then swung in a direction toward the working surface on the backing grid 2, as is shown in FIG. 2. As soon as the panel reaches the position shown in FIG. 1 and located at the end of the swinging process, the gripper together with the panel may be lowered by actuating the lifting drive 18 until the lower edge of the panel rests on the horizontal panel edge support 4. The gripper 13 continues holding the upper edge of the panel portion 8*a* fast and ensures that the upper panel portion 8*a* remains in fixed position on the working surface during the cutting process.

In the embodiment illustrated in FIG. 4, the device 10 also is provided with a cantilevered arm 12 which projects horizontally from a pivoting column 11 and is capable of being pivoted about the column in a horizontal plane. Here too, the cantilevered arm 12 projects approximately to the longitudinal center into the working surface, its gripping and fastening device consists in a cross bar 19 which spans approximately the length of the working surface and which is hinged at about one half of its length to the tip of the arm by a vertical pivot pin 20. The lifting drive 18 of the lifting device is mounted on one end (to the right in FIG. 4) of the cross bar 19. A cable line 21 extends from this lifting drive 18 and its cable is trained in such a manner that it uniformly and jointly raises and lowers two grippers independent from each other and arranged below the cross bar when the lifting drive 18 is actuated. The grippers 13 are further movable in the direction of the double arrow shown in FIG. 4, that is, along the cross bar 19, whereby they may engage the upper edge of the panel 7 at different distances. The two grippers 13 thus constitute a two-point suspension for a panel at its upper edge section and ensure that a panel engaged by its edge section is always held parallel to the cantilevered arm 12 and thus also parallel to the horizontal panel edge support 4 on the frame structure 1 because of the joint and uniform actuating of the grippers by the lifting drive 18 and the horizontally pivotal mounting of the cross bar 19 on the pivot pin 20. The chain-dotted line shown in FIG. 4 indicates the area swept by the swinging arm 12. The guiding of the cable in the cable line 21 which is necessary in the embodiment of FIG. 4 for shifting the grippers 13 will be described in detail with reference to the analogous cable guiding arrangement of the embodiment according to FIG. 5.

Figure 5:
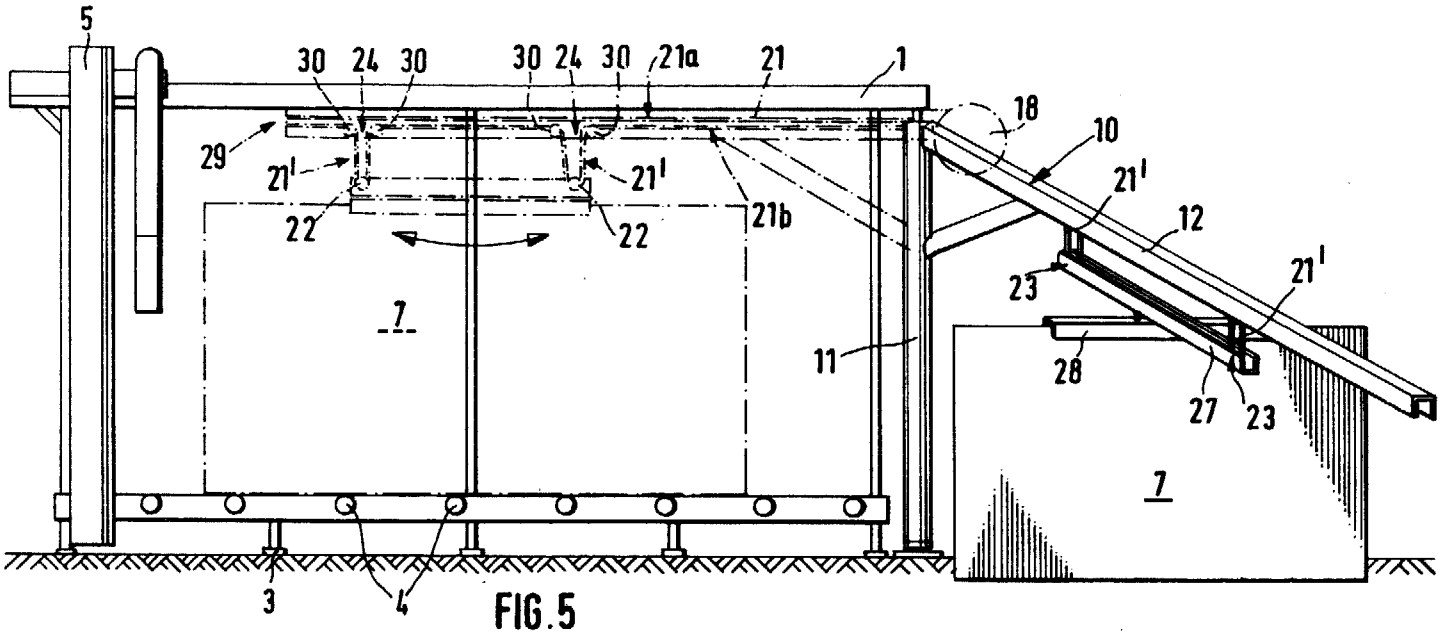
FIG. 5 is a partly perspective front view of a further embodiment of the afore-mentioned mechanism.

In this third embodiment, a trolley 27 is arranged below the terminal section of the cantilevered arm 12 which extends into the working surface and is suspended parallel to the arm and movable in the direction of elongation of the same by means of two connecting sections 23. Approximately centrally of the trolley 27 between the two connecting sections 23 which are located near its end sections, a gripper rail is pivotally mounted and permits engaging an upper panel edge of the panel 7 over a certain length and to hold it fast. A very clearly shown in the schematic view of FIG. 6, the trolley 27 consists of a U-channel beam open upward, and the gripper rail 28 also is a U-channel beam open toward the panel edge. The central pivot bearing is located on the webs of both channels. A hoisting cable extends from the lifting drive 18 conventionally indicated in FIG. 5 and is guided about a deflector 29 against the cantilevered arm tip and thus constitutes an upper cable run 21*a* and a lower cable run 21*b*. A cable loop 21' is led out of the area of the arm downward out of the lower cable run 21*b* through a deflecting element 24 for each gripper 13 according to FIG. 4 or each connecting section 23 in the trolley according to FIG. 5 and the grippers 13 or the connecting sections 23 are hooked into the loops. The cantilevered arm 12 which is constituted by a U-channel beam open in a downward direction guides the deflecting elements 24 within its interior space so that they may be shifted longitudinally of the arm. These deflecting elements 24 are constituted by a pair of pulleys 30 guided in tandem so that the cable loop 21' can be reeved through the space between each pair of pulleys and is trained about pulleys 22 rotatably supported on the connection section 23 of gripper 13. While the deflecting elements 24 according to FIG. 5 are always guided at an approximately equal spacing from each other during relative movement of the trolley 27 along the cantilevered arm because of the rotary support of the pulleys 22 at a fixed distance, the corresponding deflecting elements 24 in the embodiment of FIG. 4 may be moved freely together with the grippers 13 in the direction of the arrows by hand toward and away from each other without any change in the vertical position of the pulleys 22 relative to the cantilevered arm in either embodiment. Different cable guiding arrangements may be chosen in order to achieve the described function.

Figure 6:
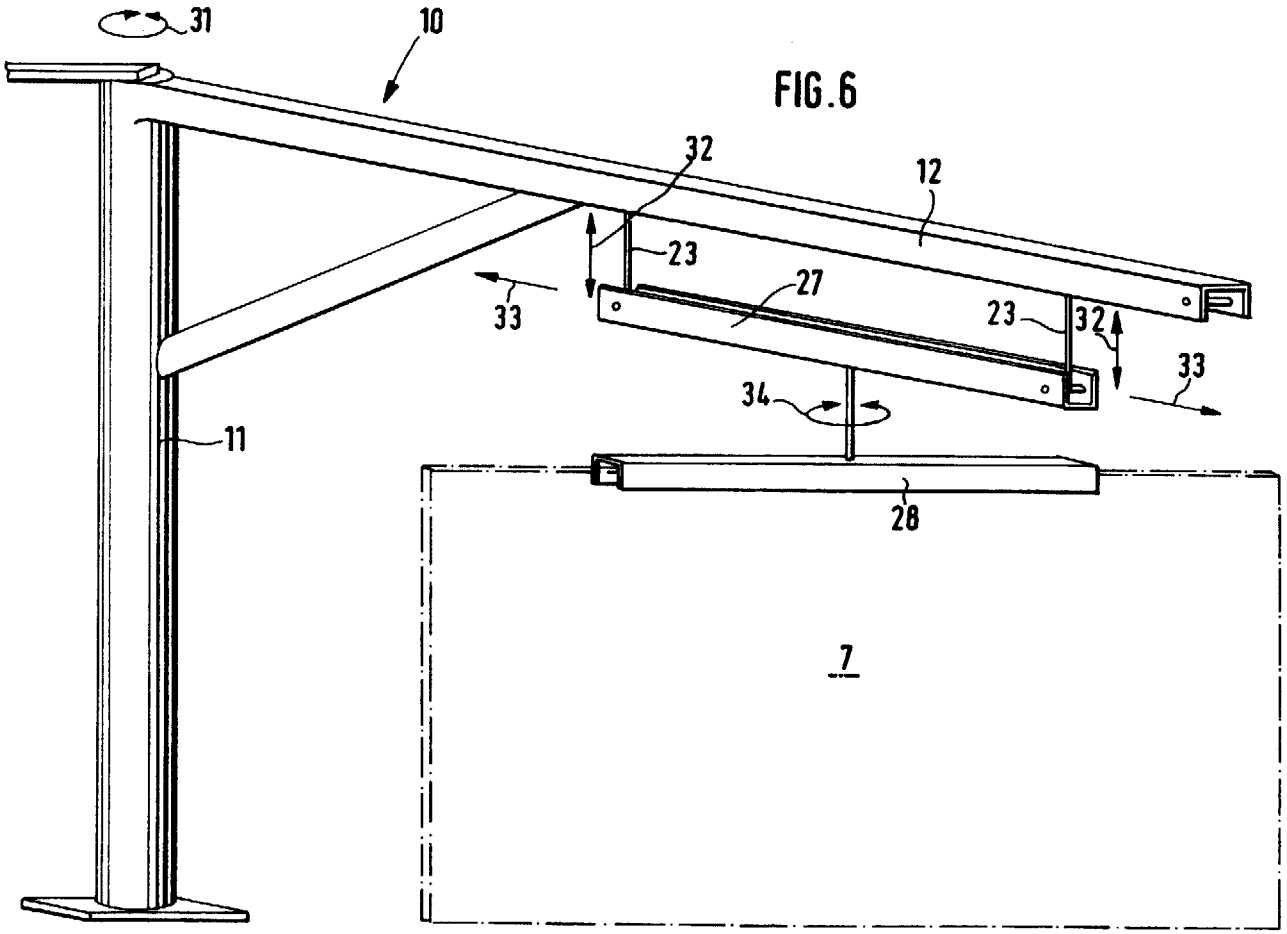
FIG. 6 is an expanded perspective view of an operating unit of the embodiment shown in FIG. 5 for illustrating the principal movement steps.

The mode of operation of the embodiment of the device 10 provided with the trolley 27 is illustrated clearly by the expanded representation according to FIG. 6. The cantilevered arm 12 is capable of pivoting together with the pivoting column 11 in the direction of the circularly arcuate double arrow 31, the pivoting movement being carried out by hand or by means of a suitable drive. The arrows 32 designate the lifting and lowering movement of the trolley 27 relative and parallel to the cantilevered arm 12 and actuated by the lifting drive, the connecting sections drawn in broken lines between the cantilevered arm 12 and the trolley 27 being correspondingly lengthened or shortened. The longitudinal movement of the trolley 27 parallel to the cantilevered arm 12 is indicated by the arrows 33, and the angular movement of the gripper rail 28 relative to the trolley 27 may occur in the direction of the circularly arcuate double arrow 34. Because the gripper rail 28 is arranged immediately below the central web surface of the trolley 27 and both structural elements are U-channel shaped as described above, the gripper rail 28, with or without engaged panel 7, necessarily assumes a practically horizontal position as soon as it is turned into a position parallel to the trolley 27. The relatively great range of pivoting movement of the cantilevered arm 12 and the movement relative thereto of a panel suspended from the gripper rail 28 make it possible that even bulky panels 7 may be withdrawn from a panel transporting carriage or a stock of panels without difficulty and avoiding obstacles and be transported to the working surface on the panel saw. It is of particular advantage that even bulky and heavy panels may be handled by means of the device 10 by only one person without great bodily effort and without danger.

Figure 7:
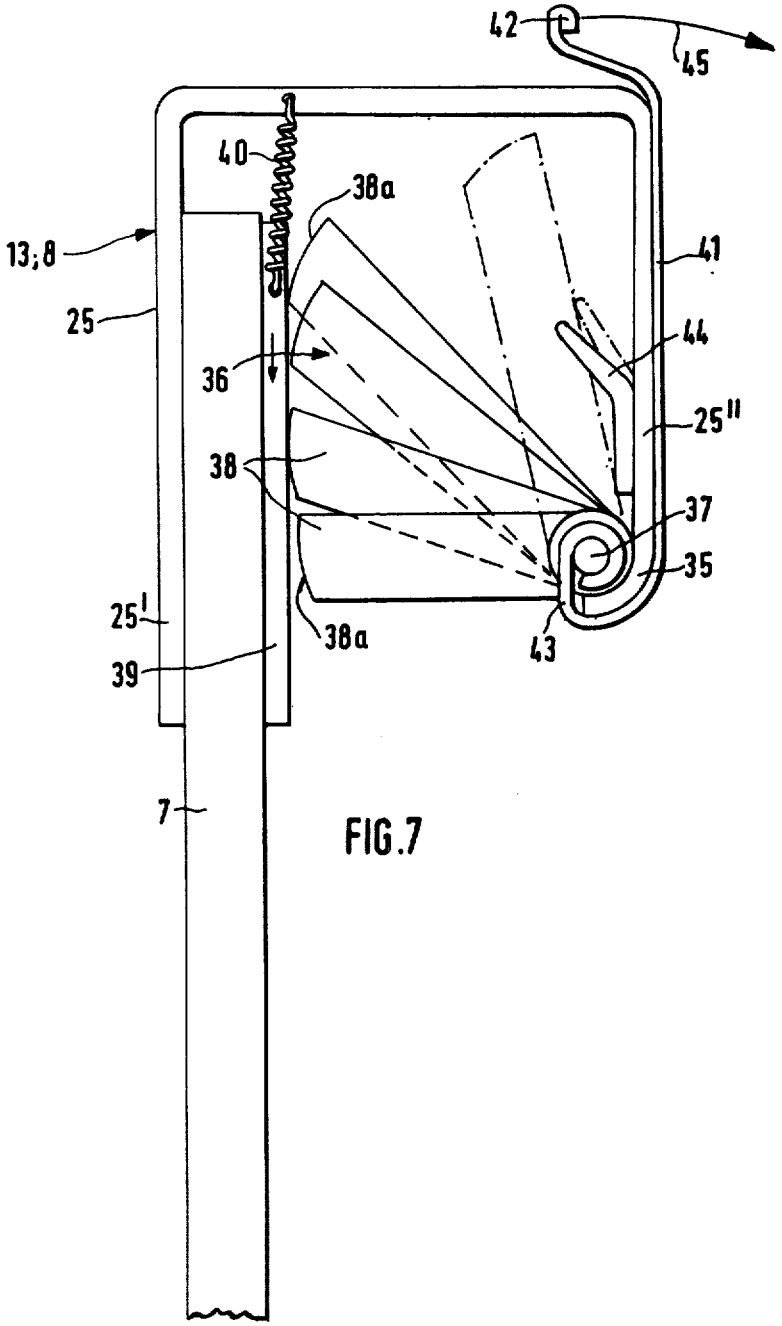
FIG. 7 is a schematic side elevation of a portion of a gripping and holding device employed in the preceding embodiments of the mechanism for cutting panels to size.

An exemplary embodiment of a gripper or a gripper rail of the gripping and fastening device is illustrated in FIG. 7 in order to make it clear in which manner the upper panel edge of a panel 7 may be held fast. One or more sets of the illustrated arrangement may be installed in a gripper shown in FIGS. 1 to 4, but it is of advantage for a gripper rail 28 that at least two sets of the holding elements shown in FIG. 7 be provided. More particularly, a U-shaped gripper channel 25 open toward the horizontal panel edge support 4 is provided according to the cross sectional or side elevational view of a gripper 13 or a gripper rail 28, and the inner clear width of the channel is greater than the greatest thickness of the panel edge of a panel 7 that is to be engaged. Clamping elements 36 are accomodated in the interior of the gripper channel 25 which select themselves automatically during introduction of panels of different panel thickness so that of the several clamping members 38 of a set 36 of clamping elements several clamping members exert such a clamping pressure on the pannel edge side area that the entire panel 7 remains firmly held within the gripper channel 25. The clamping members 38 are constituted by detent-like, flat bar sections and are jointly mounted on a pivot shaft 37 extending along a lower edge 35 of a lateral flange 25" opposite the lateral abutment surface 25' of the gripper channel 25 and are readily pivotable relative to each other on the pivot shaft. The flat bar sections have different lengths from the pivot shaft 37 to their respective front faces 38*a* so that almost the entire transverse distance between the lateral flanges 25', 25" of the gripper channel 25 may be bridged by the longest clamping members 38, whereas the lowermost flat bar section among the clamping members 38 in FIG. 7 has a front face 38*a* spaced somewhat from the opposite lateral abutment face 25'. The front faces 38*a* are eccentrically curved relative to the pivot shaft 37 which is intended to cause the clamping members 38 to exert a clamping action by engagement of the greatest possible frontal face area and not only by an edge. A protective plate 39 is inserted between the front faces 38*a* of the clamping members 38 and a lateral edge surface of a panel 7 so that the clamping members leave no marks or the like in the lateral edge surface of the panel 7. The protective plate 39 is suspended by a spring 40 for resilient movement in the direction of the arrow indicated thereon in order to permit a resilient downward movement of this protective plate 39 during the fastening of the chipboard panel 7.

The clamping members 38 of different lengths are intended to select themselves automatically according to the given panel thickness in the edge area of a panel 7 for the clamping process. This occurs advantageously in that they are readily movable on the pivot shaft 37 and always tend to tilt under their own weight into a position bridging the opening of the gripper channel 25. In order to prevent the clamping members 38 tilted by a panel edge during the insertion of the same to be pivoted inward about the pivot shaft 37 so far that their tilting moment would become too small to make them return automatically to their clamping position, a resilient abutment 44 is provided on the side flange 25" near the bearing of the pivot shaft 37 for limiting the back swinging movement of the clamping member 38.

Each set of clamping members 38 has an unlocking element 41 which may be operated from outside the gripper 13 or the gripper rail 28 for releasing the clamping members 38 from the clamping position. This unlocking element 41 is also arranged on the common pivot shaft 37 for the clamping members, and includes an unlocking strap 43 which may engage the lower sides of the clamping members 38, as viewed in FIG. 7, when the unlocking element 41 is moved in the direction of the arrow 45 by means of its lever arm 42 which rests on the outside of the gripper channel 25. In the end position of the unlocking device, all clamping members are juxtaposed in a ready position indicated in FIG. 7 by chain-dotted lines in engagement with the resilient abutment 44. Any resilient material such as rubber, plastic, or the like, may be used for the abutment 44.

The illustrated embodiments may be modified in many ways by an expert without exceeding the limits of the invention. It would be possible, for example, to substitute for a set of clamping members 38 a single, eccentrically acting and suitably shaped clamping member whose effective clamping face configuration could be spirally arcuate in cross section. Instead of mechanical clamping elements, elements actuated otherwise and having hydraulic or pneumatic clamping means may be used.

I claim:

1. In a mechanism for cutting panels having a vertically extending backing structure for backing a panel to be cut, a horizontally extending lower panel edge support, said structure and said support defining a working area, a carrier movably guided on said structure and carrying a saw unit for movement of the saw unit in said work area, and securing means for securing said panel in said work area, the improvement in the securing means which comprises:

(a) an elongated, cantilver arm having one longitudinal end portion mounted on said structure outside said work area; and (b) gripping means mounted on the other longitudinal end portion of said arm, said gripping means being upwardly spaced from said lower edge support for gripping an upper edge of said panel in said work area, said one end portion being mounted on a portion of said structure horizontally spaced from said work area for pivoting movement about a vertical axis, said gripping means including an elongated cross bar member mounted on said other end portion for movement about a vertically extending axis, a plurality of gripper elements mounted on said cross bar member for longitudinal movement thereon relative to each other, and lifting means for jointly raising and lowering said gripper elements relative to said cross bar, said lifting means including a lifting drive mounted on said cross bar, and a tension member extending along said cross bar and connecting said drive to said elements.

2. In a mechanism for cutting panels having a vertically extending backing structure for backing a panel to be cut, a horizontally extending lower panel edge support, said structure and said support defining a working area, a carrier movably guided on said structure and carrying a saw unit for movement of the saw unit in said work area, and securing means for securing said panel in said work area, the improvement in the securing means which comprises:

(a) an elongated, cantilever arm having one longitudinal end portion mounted on said structure outside said work area; and (b) gripping means on the other longitudinal end portion of said arm, said gripping means being upwardly spaced from said lower edge support for gripping an upper edge of said panel in said work area, said one end portion being mounted in a portion of said structure horizontally spaced from said work area for pivoting movement about a vertical axis, said gripping means including a trolley longitudinally movable on said other end portion, and a gripper element mounted on said trolley for angular movement about a vertically extending axis.

3. In a mechanism as set forth in claim 2, lifting means for raising and lowering said trolley relative to said other end portion.

4. In a mechanism for cutting panels having a vertically extending backing structure for backing a panel to be cut, a horizontally extending lower panel edge support, said structure and said support defining a working area, a carrier movably guided on said structure and carrying a saw unit for movement of the saw unit in said work area, and securing means for securing said panel in said work area, the improvement in the securing means which comprises:

(a) an elongated, cantilever arm having one longitudinal end portion mounted on said structure outside said work area; and (b) gripping means mounted on the other longitudinal end portion of said arm, said gripping means being upwardly spaced from said lower edge support for gripping an upper edge of said panel in said work area, said one end portion being mounted on a portion of said structure horizontally spaced from said work area for pivoting movement about a vertical axis, said gripping means including a gripper element and lifting means for raising and lowering said gripper element relative to said other end portion, said lifting means including an elongated tension member, guide means for guiding said tension member along said arm in two longitudinal runs connected at the free end of said arm, one of said runs being formed with a loop depending from said other end portion and supporting said gripper element, and drive means for longitudinally moving said tension member.

5. In a mechanism as set forth in claim 1, 2 or 4, said backing structure defining a backing surface bounding said work area and sloping in an obliquely upward direction from said edge support, said portion of said structure including a vertical column mounted for pivotal movement about the axis of said column, said column having a lower portion transversely offset from said surface away from said work area, and an upper portion transversely offset from said surface toward said work area, said arm being fixedly fastened to said column and projecting radially from said upper portion.

6. In a mechanism as set forth in claim 5, wherein said guide means include two deflecting elements spacedly fastened to each other and jointly longitudinally movable on said other end portion in guiding engagement with said one run, said loop depending between said two deflecting elements, said gripper element carrying a pulley, and said loop being trained over said pulley.

7. In a mechanism as set forth in claim 1, 2 or 4, said gripper elements including a channel-shaped gripper element bounding a recess open in a downward direction for receiving a top edge portion of a panel, and clamping means in said recess for releasably clamping said top edge portion to said gripper element.

8. In a mechanism as set forth in claim 7, said gripper element having two flange portions bounding said recess therebetween, said clamping means including a plurality of elongated clamping members pivotally mounted adjacent one of said flange portions and extending therefrom in the elongated direction thereof toward the other flange portion, said clamping elements differing in their respective lengths.

9. In a mechanism as set forth in claim 8, a pivot shaft mounted in said channel adjacent said one flange portion and defining a horizontally extending pivot axis, said clamping members having each a first longitudinal end portion secured to said pivot shaft for movement about said pivot axis and a second longitudinal end portion, each second end portion having a face transverse to the direction of clamping element elongation and arcuate about an axis of curvature spaced from said pivot axis.

10. In a mechanism as set forth in claim 9, a protective plate mounted in said recess for movement between said transverse faces and said other flange portion.

11. In a mechanism as set forth in claim 9, abutment means abuttingly engageable with each of said clamping members in said recess for preventing upward pivoting movement of each clamping member from a rest position beyond an angular end position in which gravity will cause downward pivoting movement to said rest position.

12. In a mechanism as set forth in claim 11, releasing means manually operable from outside said recess for upwardly pivoting each clamping member toward said end position.

* * * * *